US009486685B2

(12) United States Patent
Rambo

(10) Patent No.: US 9,486,685 B2
(45) Date of Patent: Nov. 8, 2016

(54) APPARATUS FOR PROVIDING SWING TECHNIQUE FEEDBACK

(71) Applicant: Jay Rambo, Spokane, WA (US)

(72) Inventor: Jay Rambo, Spokane, WA (US)

( * ) Notice: Subject to any disclaimer, the term of this patent is extended or adjusted under 35 U.S.C. 154(b) by 0 days.

(21) Appl. No.: 14/631,458

(22) Filed: Feb. 25, 2015

(65) Prior Publication Data

US 2016/0243420 A1 Aug. 25, 2016

(51) Int. Cl.
*A63B 69/00* (2006.01)
*A63B 71/06* (2006.01)

(52) U.S. Cl.
CPC ..... *A63B 69/0002* (2013.01); *A63B 71/0619* (2013.01); *A63B 2069/0008* (2013.01); *A63B 2071/0602* (2013.01); *A63B 2208/0204* (2013.01)

(58) Field of Classification Search
CPC . A63B 53/00; A63B 15/005; A63B 69/0002
USPC ..... 473/422, 437, 457, 519, 520, 564–568
See application file for complete search history.

(56) References Cited

U.S. PATENT DOCUMENTS 3,136,546 A 6/1964 Connolly
3,137,504 A 6/1964 Zordan et al.
3,498,616 A * 3/1970 Hurst ..... A63B 69/3635 473/234
3,572,706 A 3/1971 Schroder
4,267,793 A 5/1981 Lane et al.
4,759,219 A 7/1988 Cobb et al.
4,778,863 A 10/1988 Wang et al.
4,834,376 A 5/1989 Steinberg
4,871,168 A 10/1989 Autorino et al.
4,953,868 A 9/1990 Thompson et al.
5,056,783 A 10/1991 Matcovich et al.
5,082,283 A 1/1992 Conley et al.
5,590,875 A 1/1997 Young
6,050,908 A 4/2000 Muhlhausen
6,173,610 B1 1/2001 Pace
6,193,620 B1 2/2001 Tarng
6,220,719 B1 4/2001 Vetorino et al.
6,569,042 B2 5/2003 LaChance et al.
D480,122 S 9/2003 Ciesar et al.
6,630,520 B1 10/2003 Bruza et al.
6,770,002 B2 8/2004 Aigotti
6,812,583 B2 11/2004 Cheung et al.
6,830,520 B1 * 12/2004 Bollar ..... A63B 15/005 473/457
7,008,351 B2 3/2006 Parker
7,056,240 B2 6/2006 Brock et al.
7,147,580 B2 * 12/2006 Nutter ..... A63B 15/005 473/457
7,229,188 B2 6/2007 Mah
2008/0305895 A1 12/2008 Gant
2010/0184526 A1 * 7/2010 Park ..... A63B 53/00 473/226
2014/0121042 A1 * 5/2014 Nutter ..... A63B 69/0002 473/457

* cited by examiner

*Primary Examiner* — Nini Legesse
(74) *Attorney, Agent, or Firm* — Lee & Hayes, PLLC

(57) ABSTRACT

This disclosure describes an apparatus used to provide feedback of a proper swing technique. According to some embodiments, the disclosure describes an outer shaft having a ball bearing adjustably attached to a magnet recessed within an internal tube. According to some embodiments, the ball bearing may be released from the magnet when the apparatus is properly swung. According to some embodiments, haptic and/or auditory feedback may be provided to a user of the apparatus as the ball bearing contacts a stopper tube in the outer shaft.

19 Claims, 11 Drawing Sheets

APPARATUS FOR PROVIDING SWING TECHNIQUE FEEDBACK

BACKGROUND

It is generally well known that hitting a thrown ball in, for example, fast pitch softball is extremely difficult. This is largely due to the trajectory of the ball as it travels upwards toward the batter and the reaction time necessary for the batter to make contact with the ball. In many case where the batter has an "upper-cut" swing, meaning that the batter's hands move from a low-to-high position as the batter swings the bat, the difficulty in making contact with the ball is increased since the bat is moving at an opposite trajectory from the ball. As such, a training apparatus which reinforces a swing where the batter's hands either move from a high-to-low position or in a similar trajectory to the ball, would be useful in reducing the difficulty in hitting a thrown ball.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

Figure 1:
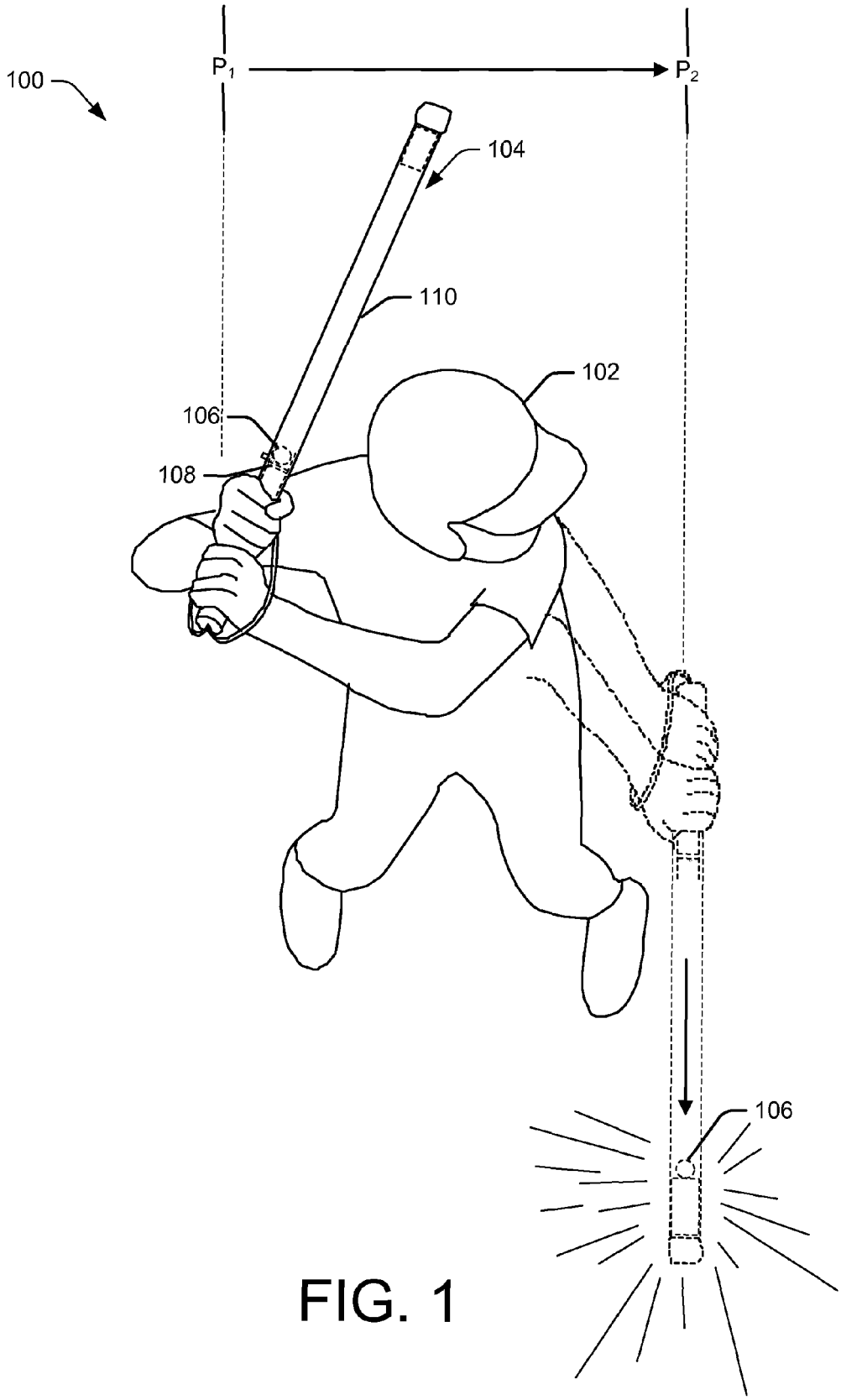
FIG. 1 illustrates an example environment of providing feedback where a batter swings an apparatus with a proper swing technique.

This disclosure describes embodiments of an apparatus for providing feedback of a swing technique. For instance, this disclosure describes an apparatus configured to provide feedback (e.g., haptic or auditory) as a user swings the apparatus to indicate a proper swing technique. Generally, it may be less difficult to make contact with a thrown ball when the bat is swung in a substantially similar plane as the thrown ball. In addition, a batter that drops their hands as an initial movement of their swing may allow the head of the bat to start below the trajectory of the thrown ball resulting in an increased difficulty in making substantial contact with the thrown ball. For example, in fast pitch softball, a thrown ball may have a flat or upward trajectory as it passes by the batter and through the strike zone. Therefore, the batter may have increased success making substantial contact with the thrown ball if the bat is swung from a high-to-low plane similar to the plane of the trajectory of the thrown ball. In order to make such a "proper" swing (hereinafter, "high-to-low"), the batter's hands, upon beginning a swing, should begin at a higher position as compared to a lower position as the batter moves the bat and, therefore, hands through the strike zone.

In one embodiment, the disclosure describes an apparatus having an outer shaft with an internal tube secured in the outer shaft at an end where a batter may grip the apparatus. In some embodiments, the internal tube may have a magnet attached to an end substantially distal to the grip end of the apparatus. A ball (e.g., a ball bearing containing a portion of iron or steel) may be placed in the outer shaft to interact with the magnet located at or near the end of the internal tube. For instance, when the apparatus is held by a user in batting stance, the magnet may be affixed to a portion of the magnet. In some embodiments, an adjustment mechanism may adjust a portion of the ball which interacts with the magnet.

In some embodiments, the adjustment mechanism may increase or decrease the attachment of the ball to the magnet to account for the size and/or strength of the user. In some embodiments, when the apparatus is swung with the proper "high-to-low" swing technique the ball may release from the magnet and travel a substantial length of the outer shaft. In some embodiments, the length of the outer shaft may be variable such that the ball may be configured to travel a length of the outer shaft and contact a stopper mechanism located at a distal end of the outer shaft as the apparatus reaches a would be ball-bat contact point in the swing, thus providing a haptic and/or auditory feedback that the swing was a proper "high-to-low" swing.

In some instance, when the apparatus is swung in an improper plane, such as an "upper-cut" or "low-to-high" hand position, the ball bearing may not release from the magnet located on or near the end of the internal tube. In this instance, the user of the apparatus would not receive the feedback, thus indicating an improper swing.

The term "about" or "approximate" as used in context of describing example apparatuses for providing feedback of a proper swing is to be construed to include a reasonable margin of error that would be acceptable and/or known in the art.

As used herein, the terms "a," "an," and "the" mean one or more.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "having," "has," "contain," "including," "includes," "include," and "have" have the same open-ended meaning as "comprising," "comprises," and "comprise" provided above.

The present description may use numerical ranges to quantify certain parameters relating to the invention. It should be understood that when numerical ranges are provided, such ranges are to be construed as providing literal support for claim limitations that only recite the lower value of the range as well as claim limitations that only recite the upper value of the range. For example, a disclosed numerical range of 24 to 36 provides literal support for a claim reciting "greater than 24" (with no upper bounds) and a claim reciting "less than 36" (with no lower bounds) and provides literal support for and includes the end points of 24 and 36.

This overview is provided to introduce a selection of concepts in a simplified form that are further described below. The overview is provided for the reader's convenience and is not intended to limit the scope of the claims, nor the proceeding sections.

Example Environment

Figure 2:
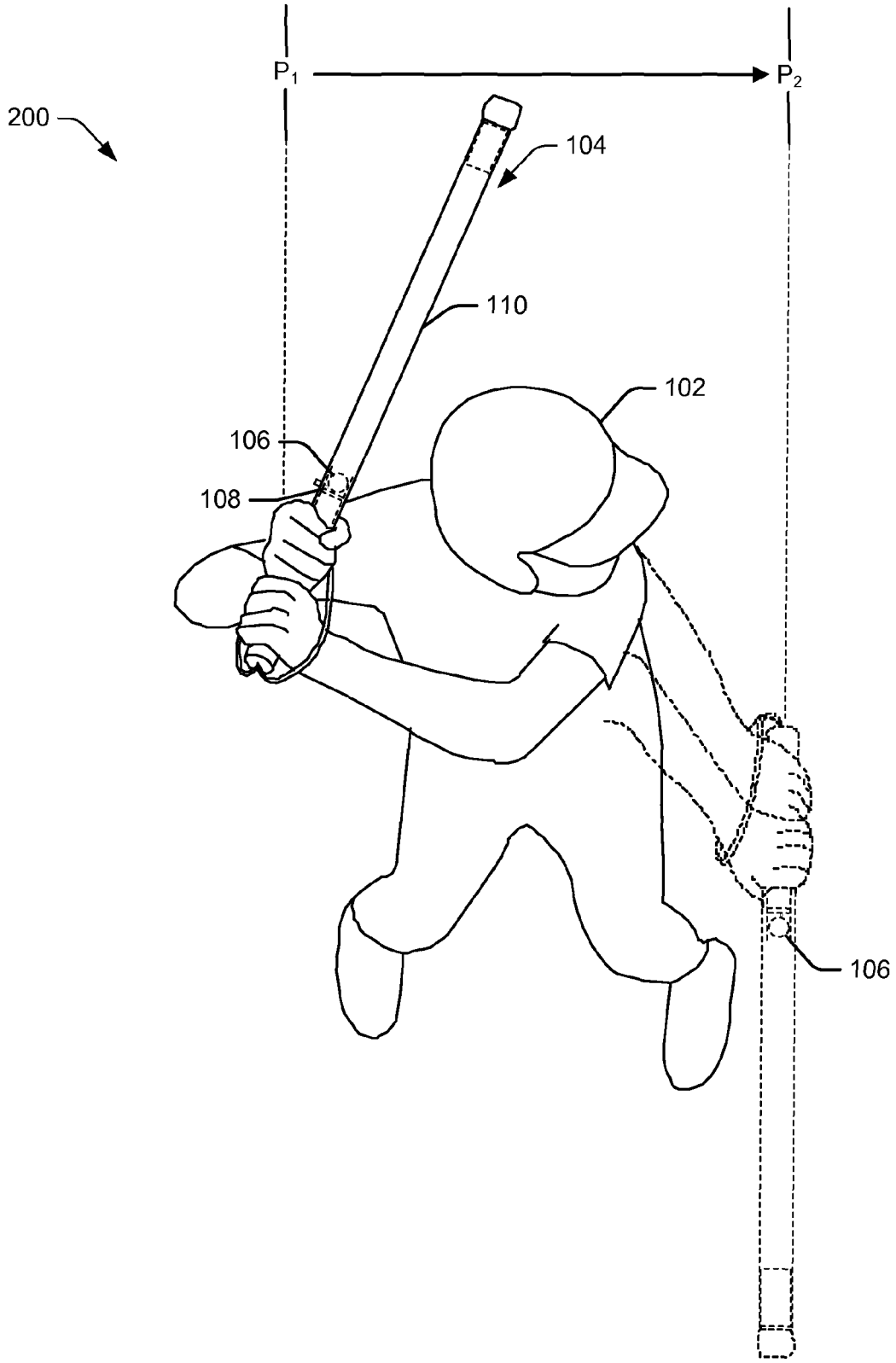
FIG. 2 illustrates an example environment when an apparatus refrains from providing feedback where a batter swings the apparatus with an improper swing technique.

FIGS. 1 and 2 illustrate example environments 100 and 200, respectively, for the use of the apparatus for training a proper swing technique. FIG. 1 shows a user 102, such as a batter, holding the apparatus 104 at a position $P_1$ corresponding to a set, ready position prior to starting a swing. As shown in the apparatus 104, the ball (hereinafter, "ball bearing") 106 may be attached to a magnet 108 within the outer shaft 110 of the apparatus 104 while in position $P_1$.

In some embodiments, when the user 102 manipulates the apparatus 104 toward a position $P_2$ by moving the hands from a "high-to-low" position as described above, the ball bearing 106 may detach from the magnet 108. In some embodiments, the ball bearing 106 may travel down the outer shaft 110 toward a distal end of the apparatus 104 toward a stopper tube (not shown). The ball bearing 106 may strike the distal end of the apparatus (or stopper tube) at an apex of the user's swing as shown at $P_2$. In this instance, the apex of the swing may be the point at which a user may make contact with the ball. As shown in FIG. 1, the ball bearing 106 striking the distal end of the apparatus (or stopper tube) may create a distinct "snap" feedback felt and/or heard by the user 102. In this embodiment, the feedback would immediately notify the user 102 that the user kept his/her hands up, and swung the apparatus in a linear direction while dropping the distal end of the apparatus through the plane of an imaginary ball.

FIG. 2 illustrates an environment 200 where the user 102 does not swing the apparatus 104 with a proper "high-to-low" technique. As shown, position $P_1$ is substantially the same as position $P_1$ shown in FIG. 1 where the ball bearing 106 is attached to the magnet 108.

In some embodiments, when the user 102 manipulates the apparatus 104 to a position $P_2$ by moving the hands in a plane other than a "high-to-low" technique, the ball bearing 106 may remain attached to the magnet 108. For instance, the ball bearing 106 may remain attached to the magnet 108 when the user 102 swings the apparatus 104 in a "low-to-high", "uppercut" and/or a substantially level plane. As a result of the ball bearing 106 remaining attached to the magnet 108, the feedback (i.e., "snap") described with regard to FIG. 1 may not be present, thus indicating that the swing was improper.

While FIGS. 1 and 2 do not illustrate an adjustment mechanism to alter the connection of the ball bearing 106 to the magnet, apparatus 104 may include such adjustment mechanism as will be described below. In other embodiments, the apparatus 104 may be configured with a magnet of a specific size, strength, and/or composition such that the adjustment mechanism may not be needed to allow the apparatus to provide the feedback or lack thereof described in FIGS. 1 and 2.

Example Apparatuses

Figure 3:
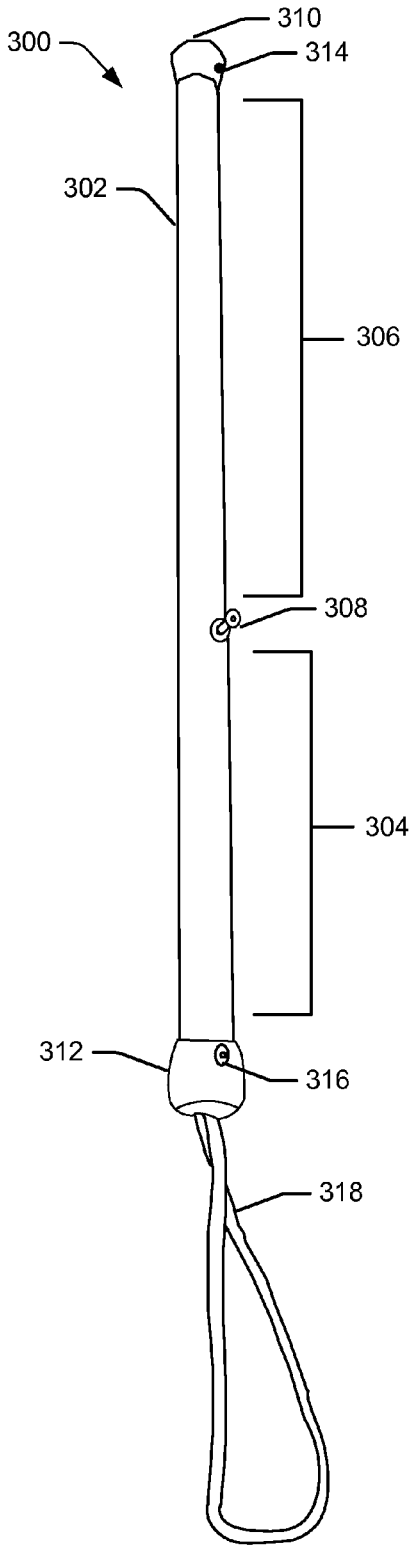
FIG. 3 illustrates a perspective view of an example configuration of an assembled apparatus for providing feedback of a proper swing technique.

FIGS. 3-12 illustrate example embodiments or example components of an apparatus for providing feedback of a proper swing technique. FIG. 3. illustrates a perspective view of an assembled apparatus 300. As shown, apparatus 300 includes an outer shaft 302. Outer shaft 302 may be a round, hollow metal tube with a diameter from about 1 inch to about 1.5 inches. In some embodiments, the outer shaft 302 may have a length of about 24 inches to about 36 inches. In some embodiments, the outer shaft 302 may be aluminum tube or conduit. In some embodiments, the outer shaft 302 may be a seamed or a seamless steel (e.g., galvanized or stainless) tube. In some embodiments as described below, the outer shaft may comprise a diameter of greater than one (1) inch or less than one (1) inch and/or the outer shaft may have a tapered diameter. Furthermore, the surface of the outer shaft 302 may painted and/or decaled in any color scheme. For instance, the surface of the outer shaft 302 may be colored with in any combination of cardinal red and/or white and/or include a decal or sticker representing a razorback hog from the University of Arkansas.

Outer shaft 302 may be divided generally into two portions: a grip portion 304 and a barrel portion 306. In some embodiments, the grip portion 304 may correspond to a portion where a user may hold the apparatus 300. In some embodiments, the entire grip portion 304 or a substantial portion of the grip portion 304 may be covered by an additional agent (not shown) to enhance the user's ability to grasp the apparatus 300. For instance, the grip portion 304 may be covered with tape, leather or synthetic wrap (e.g., cushioned wrap and/or tacky wrap), bat wax, rosin, a taper enhancer, or the like.

As will be described below, the barrel portion 306 of the outer shaft 302 may be configured to be longer than the grip portion 304. For instance, in some embodiments, the barrel portion 306 may comprise ⅔ the total length of the apparatus while the grip portion may comprise the remaining ⅓ of the apparatus. In addition, the barrel portion 306 may be hollow to allow the ball bearing to travel down an inner portion of the barrel portion 306 as a user may complete a proper swing technique as described above.

In some embodiments, the grip portion 304 and the barrel portion 306 may be generally separated at a location of an adjustment mechanism 308 on the outer shaft 302. The adjustment mechanism 308 may include a housing unit and a threaded fastener (e.g., screw). In some embodiments, the threaded fastener may be a ⅛ inch diameter screw with a length of ¾ inch. In some embodiments, the adjustment mechanism 308 may include a screw configured to interact directly with a threading portion of the outer shaft 302 (i.e., without the housing). As mentioned, the adjustment mechanism 308 may be used to vary the contact surface of the ball bearing to a magnet within the outer shaft 302. Further details of the adjustment mechanism 308 are described more fully below. Furthermore, as described with reference to FIGS. 5, 6, and 10 below, the outer shaft 302 may include a protective shield to protect the adjustment mechanism 308.

In some embodiments, apparatus 300 may include a first cap 310 and a second cap 312. In some embodiments, the first cap 310 and second cap 312 may be attached to the outer shaft 302 by a first fastener 314 and a second fastener 316, respectively. In some embodiments, the first cap 310 and the second cap 312 may be substantially the same and/or comprised of the same material. For instance, as shown in FIG. 3, both the first cap 310 and the second cap 312 may be a removable rubber cap to facilitate access to internal components of the apparatus as described with reference to FIG. 4. However, in other embodiments, the first cap 310 and the second cap 312 may be different. For instance, the first cap 310 may be a removable rubber cap while the second cap 312 may be a traditional knob of a softball/baseball bat that may be integrated with the outer shaft 302.

The first fastener 314 and the second fastener 316 may be a threaded fastener (e.g., screw), a rivet, or the like. In some embodiments, a retainer nut or weld nut (not shown) may be attached to the outer shaft to allow the first fastener 314 and the second fastener 316 to hold the first cap 310 or the second cap 312 in place relative to the outer shaft. In some embodiments, the first fastener 314 and the second fastener 316 may be the same or different type of fastener. While FIG. 3 illustrates a first fastener 314 and the second fastener 316 to attach the first cap 310 and the second cap 312 to the outer tube 302, respectively, any number of fasteners may be used to securely attach each cap to the outer shaft 302.

In some embodiments, the first cap 310 and the second cap 312 may be attached to the outer shaft 302 without fasteners. For example, in some embodiments, the outer shaft 302 may include a first cap 310 and the second cap 312 which may be domed or un-domed cap (e.g., a steel cap or aluminum cap). In such embodiments, the first cap 310 and the second cap 312 may be attached to the outer shaft 302 by threading, crimping, welding, soldering, brazing, gluing, cementing, or the like.

Apparatus 300 (and any other apparatus describe herein) may include a wrist strap 318 as shown in FIG. 3. As shown, wrist strap 318 may be incorporated or attached to an internal portion of the second cap 312 by any known method. Strap 318 may be configured to fit around a user's wrist or wrists as the user grips the grip portion 304 and also as the user swings the apparatus 300. In some embodiments, strap 318 may be constructed of leather, cotton cordage, synthetic polyamide rope, or the like.

Figure 4:
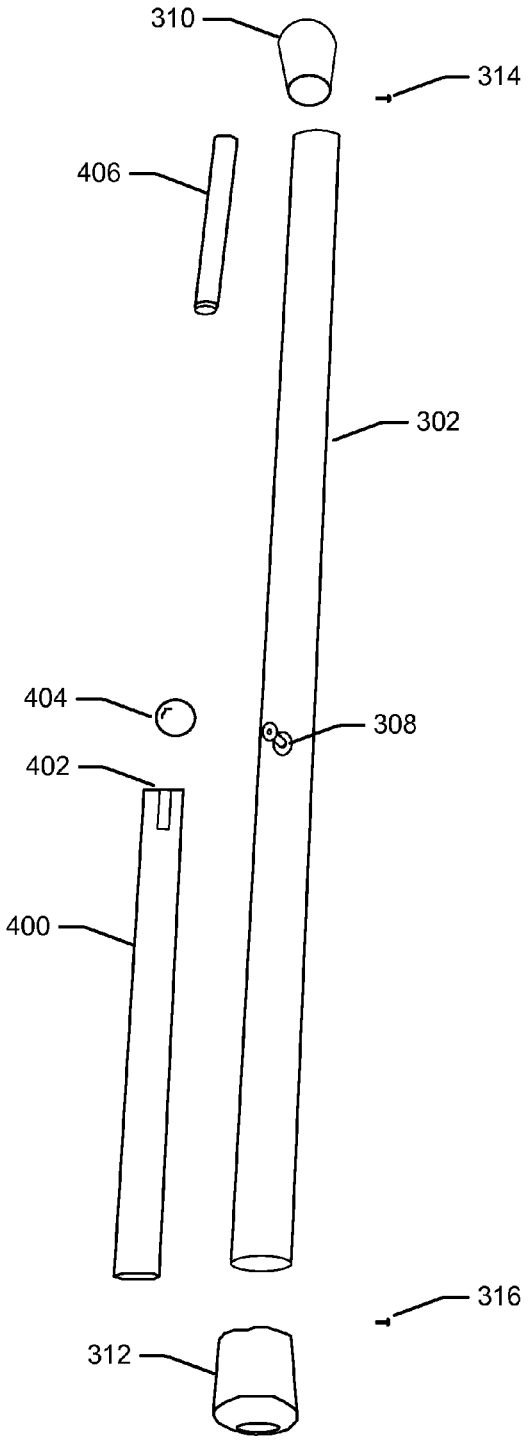
FIG. 4 illustrates a perspective view of example internal components of the apparatus shown in FIG. 3 for providing feedback of a proper swing technique.

FIG. 4 illustrates a perspective view of example internal components of the apparatus 300 described with reference to FIG. 3. As shown in FIG. 4, an internal tube 400 may be configured to hold a magnet 402. The internal tube may have a diameter less than a diameter of the outer shaft 302. For instance, the internal tube 400 may have be a round, hollow metal tube with a diameter of about ¾ inch. In other embodiments, the internal tube 400 may have inside diameter of ⅝ inch. In some embodiments, the internal tube 400 may be electrical metallic tube (EMT) or conduit. In some embodiments, the internal tube 400 may be steel tubing as described above with reference to the outer shaft 300. In some embodiments, the internal tube 400 may have a length of about 8 inches.

As shown in FIG. 4, the internal tube 400 may have a length substantially similar to a length of the grip portion 304 of the outer shaft 302. In some embodiments, the length of the internal tube 400 may configured to hold the magnet 402 in a position immediately below the threaded fastener of the adjustment mechanism on the internal portion of the outer shaft 302. In some embodiments, as describe in detail below, the internal tube 400 may have an about ½ inch to about a 1 inch length slot down the internal tube 400. The slot may allow the adjustment mechanism to interact with a position of a magnet which may be recessed into the internal tube 400.

In some embodiments, the internal tube 400 may be held in a position relative to the outer shaft 302 and adjustment mechanism by the second fastener 316. In other embodiments, the internal tube 400 may be held in place with more than one fastener positioned at one or more locations.

Magnet 402 may be a disc magnet configured to interface with an end of the internal tube 400 nearest the location of the adjustment mechanism 308. In some embodiments, the magnet 402 may have a diameter larger than the outer diameter of the internal tube 400 but smaller than the internal diameter of the outer shaft 302. In some embodiments, magnet 402 may be glued and otherwise adhered to the distal end of the internal tube 400. In other embodiments, as shown with reference to FIGS. 5 and 9, the magnet 402 may have a diameter smaller (e.g., ½ inch) than the inner diameter (⅝ inch) of the internal tube 400 and may be configured to be recessed within a distal end of the internal tube 400. In some embodiments, the magnet may have a diameter from about ⅜ inch to about ¾ inch.

In some embodiments, magnet 402 may be a disc or ring (e.g., ceramic or neodymium) magnet with at least a thickness of 1/32 inch. In some embodiments, magnet 402 may have an outer diameter the same as the internal diameter of the internal tube. For instance, in embodiments where the internal tube 400 has an internal diameter of ⅝ inch the magnet may have an overall diameter of ⅝ inch. In some embodiments, magnet 402 may be covered, coated, or dripped in a plastic (e.g., polyethylene or polythene), rubber, silicone, other elastic polymer (e.g., viscoelastic urethane polymer, polynorbornene, etc.) to provide protection as ball bearing 404 contacts the magnet. Additionally or alternatively, a protective disc (e.g., plastic or metallic) may be placed over the magnet 402 to provide protection as the ball bearing 404 contacts the magnet.

FIG. 4 also illustrates ball bearing 404 which may be at least partly a steel bearing having a diameter from about ½ inch to about ⅝ inch diameter. In some embodiments, ball bearing may have magnetic qualities configured to interact with a iron surface of the internal tube. In these embodiments, the outer shaft, stopper tube and other internal component of the apparatus may be configured with a non-magnetic material so as to not interfere with the magnetic ball bearing.

Ball bearing 404 may be generally loose within outer shaft 302; however, magnet 402 would be configured to attract or magnetically connect to the ball bearing when the ball bearing is within a predetermined distance to the magnet and based on a position of the adjustment mechanism 308. In some embodiments, ball bearing 404 may fit within a recessed portion of the internal tube 400.

In some embodiments, a stopper tube 406 may be positioned inside the outer shaft 302 and at an end of the outer shaft 302 distal to the internal tube 400. In some embodiments, the stopper tube 406 is configured to stop the ball bearing 404 as the ball bearing 404 travel down the outer shaft 302 when the user makes a proper "high-to low" swing technique as described above. In addition, when the ball bearing 404 strikes the stopper tube 406 a haptic sensation and/or auditory sound may be produced, thus, serving as feedback perceived by the user.

In some embodiments, the stopper tube 406 may be the same material and diameter as the internal tube 400. In some embodiments, the stopper tube 406 may include an energy absorbing cylinder (e.g., rubber, silicone, other elastic polymer (e.g., viscoelastic urethane polymer, polynorbornene, etc.) cylinder or spring mechanism) incased in a metallic housing. In some embodiment, the energy absorbing cylinder may have a metallic fastener configured to interact with the ball bearing 404 as it travels to a distal end of the outer shaft 302 to provide the feedback perceived by the user (i.e., haptic sensation and/or auditory sound) as the ball bearing contacts to the stopper tube 406.

In some embodiments, the length of the stopper tube 406 may be configured to vary based on a desired length of travel of the ball bearing through the outer shaft 302 as a user swings the apparatus 300. Generally, the longer the outer shaft 302 the longer the stopper tube 406 may be. The stopper tube 406 may be held in a position relate to the outer shaft 302 by the first fastener 314. In other embodiments, the stopper tube 406 may be held in place with more than one fastener positioned at one or more locations.

Figure 5:
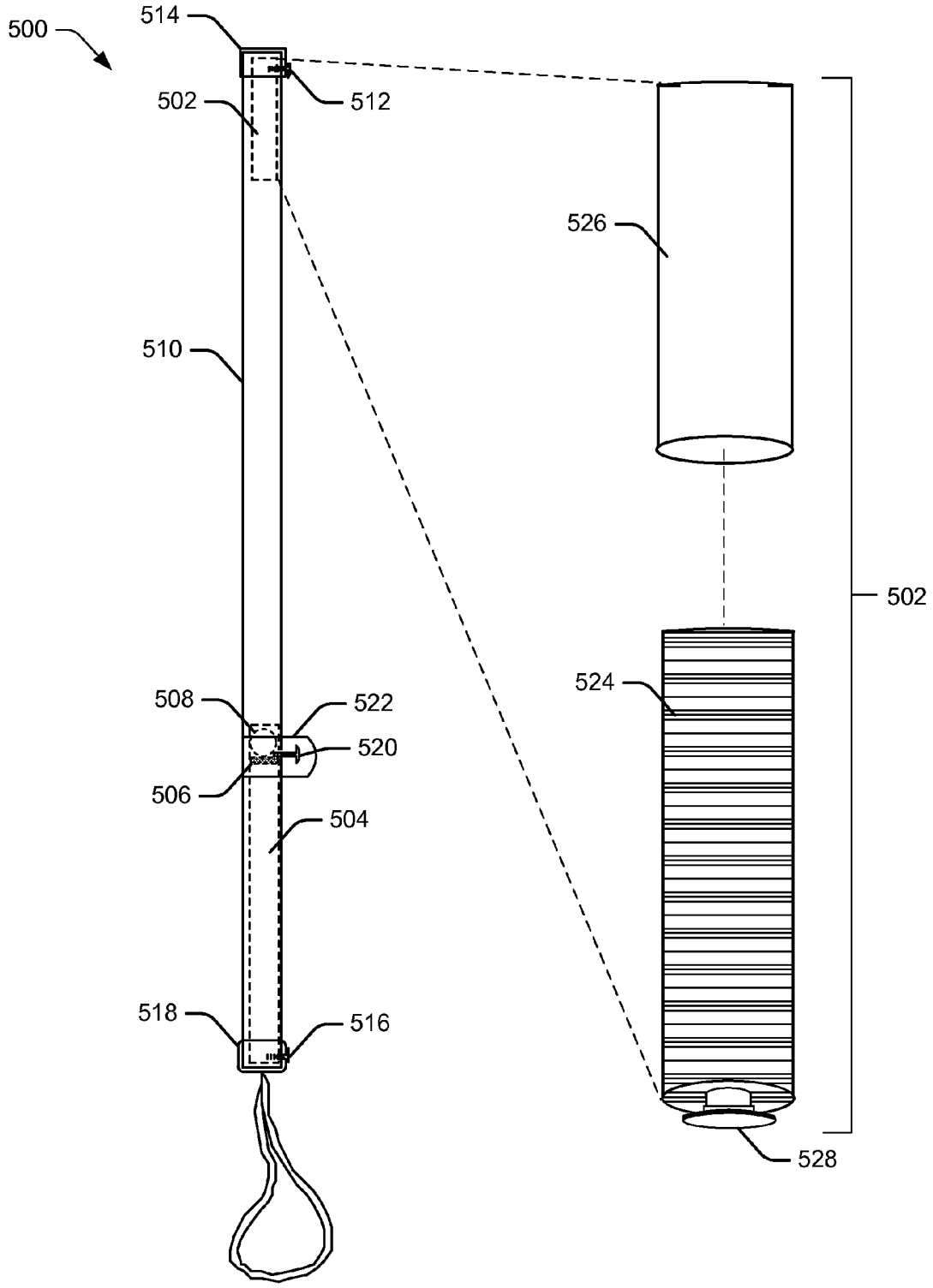
FIG. 5 illustrates a cutaway view of an example embodiment of an apparatus for providing feedback of a proper swing technique.

FIG. 5 illustrates a cutaway view of an example embodiment of the apparatus 500 for providing feedback of a proper swing technique. As shown in FIG. 5, stopper tube 502, internal tube 504 with recessed magnet 506, and ball bearing 508 may be placed within outer shaft 510. In addition, a first fastener 512 may be configured to hold a first cap 514 on an end of the outer shaft 510 as well as secure the stopper tube 502 relative to the outer shaft 502. In some embodiments, a second fastener 516 may be configured to hold a second cap 518 on an end of the outer shaft 510 as well as secure the internal tube 504 relative to the outer shaft 502.

FIG. 5 further illustrates an adjustment mechanism 520 on the outer shaft 510. In some embodiments, a shield 522 may be attached to the outer shaft 510 to protect the adjustment mechanism 520 from inadvertent contact. Shield 522 may be made of a sheet of fabricated metal or plastic and will be described below with regard to FIG. 10. Adjustment mechanism 520 is shown as a threaded fastener protruding from an external portion of the outer shaft 510 into an inner portion of the outer shaft 510. In some embodiments, a housing such as a steel (e.g., stainless or galvanized) nut (e.g., retaining, weld, etc) may be secured to the outer shaft 510 to provide a location for the threaded fastener to protrude to the inner portion of the outer shaft 510. The location of the protrusion of the adjustment mechanism 520 may be configured such that the internal portion of the adjustment mechanism 520 is proximate to a top surface of magnet 506 attached to or recessed within the internal tube 504. In some embodiments, the adjustment mechanism 520 may be manipulated to increase or decrease the amount of the internal portion of the threaded fastener within the outer shaft 510. For instance, the more the threaded fastener of the adjustment mechanism 520 is manipulated to increase an amount of the threaded fastener within the outer shaft 510, the less surface area of the magnet 506 will be exposed to the ball bearing 508. In this instance, the ball bearing 508 may have less magnetic attraction to the magnet 506 and thus be more easily separated from the magnet 506.

Conversely, in some embodiments, where less of the threaded fastener of the adjustment mechanism 520 is protruded within the outer shaft 510 just above the magnet 506, more surface area of magnet 506 may be exposed to the ball bearing 508. In this instance, the ball bearing 508 may have an increased magnetic attraction to the magnet 506 and thus may be more difficult to separate from the magnet 506 as the user swings the apparatus.

As described herein, a user may adjust the adjustment mechanism 520 based on several factors. For instance, adjustment of the magnetic attraction between the magnet and the ball bearing may need to be adjusted based on the size and/or strength of the user of the apparatus; the size of the apparatus itself; and/or a swing technique of the user (i.e., the user's ability to keep their hands up and the drop the distal end of the apparatus through a hypothetical ball contact area or the user's ability to swing the apparatus directly to a position of the hypothetical ball contact area without extending their hand out and around the hypothetical ball contact area).

FIG. 5 also illustrates an exploded view of the stopper tube 502. As shown, stopper tube 502 may include an energy absorbing cylinder 524. In some embodiments, energy absorbing cylinder 524 may comprise rubber, silicone, other elastic polymer (e.g., viscoelastic urethane polymer, polynorbornene, etc.) cylinder or spring mechanism to absorb the energy from the ball bearing as it strikes the stopper tube during a proper swing. In some embodiments, the energy absorbing cylinder 524 may be substantially incased within a housing 526. Housing 526 may be a metallic tube with a length less than a length of the energy absorbing cylinder 524. In some embodiments, the first fastener 512 may be configured to hold the housing and the energy absorbing cylinder 524 in place at an end of the outer shaft 510 which is distal from the user of the apparatus 500.

Energy absorbing cylinder 524 may include a metallic fastener 528 (e.g., a carriage bolt) at a portion of the cylinder 524 protruding from the housing 526. The metallic fastener 528 may be configured to interact with the ball bearing 508 as the ball bearing travel down the outer shaft 510 during a proper swing by a user. In some instance, when the ball bearing 508 contacts the fastener 528, a haptic feedback and/or audible feedback may be perceived by the user which may indicate the swing of the apparatus 500 was a proper "high-to-low" swing.

Figure 6:
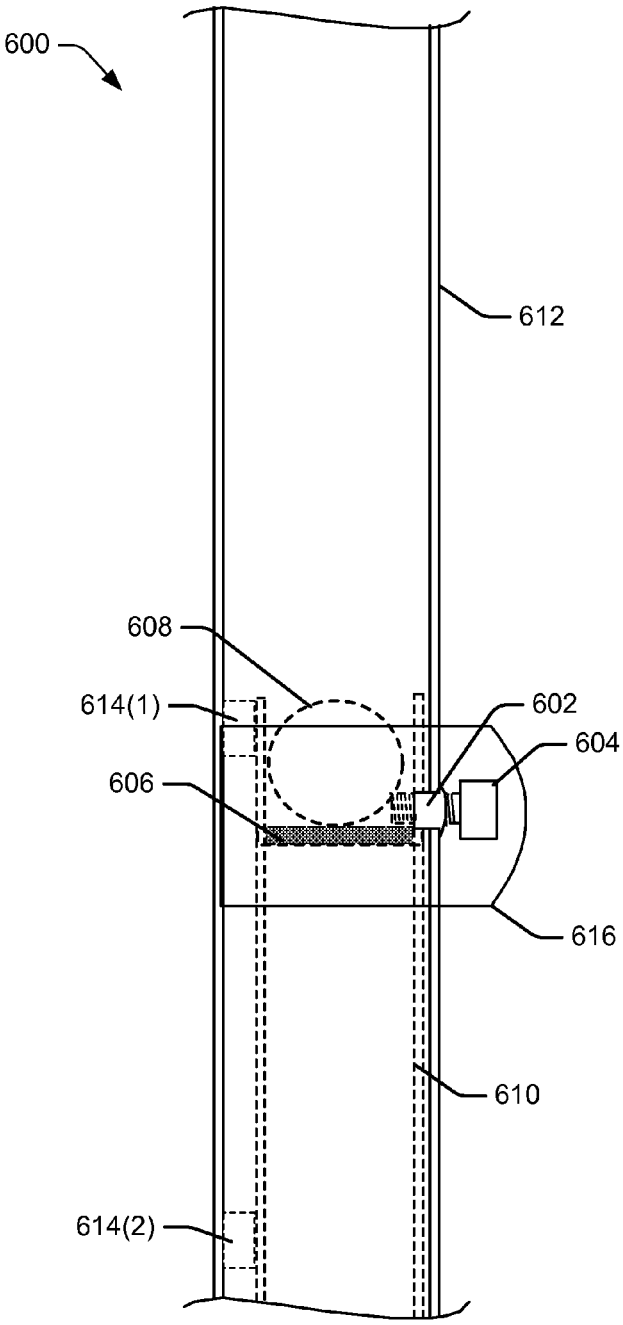
FIG. 6 illustrates a cross-sectional view of an example embodiment of a release mechanism of an example apparatus for providing feedback of a proper swing technique.

FIG. 6 illustrates a cross-sectional view of an example section of apparatus 600 showing a position of a housing unit 602 and threaded fastener 604 of an adjustment mechanism relative to a magnet 606 and ball bearing 608 recessed in an internal tube 610. In some embodiments, housing unit 602 may be attached (e.g., welded) to the outer shaft 612. Housing unit 602 may include a threaded pathway for the threaded fastener 604 to attach to the housing unit 602 and, ultimately, apparatus 600. Furthermore, housing unit 602 may hold the threaded fastener 604 to form the aforementioned adjustment mechanism.

As shown in FIG. 6, the housing 602 and threaded fastener 604 may be located in a position on the outer shaft 612 so as they may interact with a recessed portion of the internal tube 610. In some embodiments, the internal tube 610 may include a recessed or slotted portion as described with regard to FIG. 7 below. In other embodiments, the housing unit 602 and the threaded fastener 604 may protrude through a wall of the internal tube 610.

In some embodiments, the magnet 606 may be positioned within the recessed portion of the internal tube 610. In some instance, the magnet may be secured from about ½ inch to about 1 inch from an end of the internal tube 610. As shown in FIG. 6, the threaded fastener 604 may extend into the outer shaft 612 and internal tube 610 at a location directly above the top surface of the magnet 606. As described above, the threaded fastener 604 may be adjusted to extend more or less of a portion of the fastener 604 into the internal tube 610. Such adjustment may alter a surface of the magnet 606 exposed to the ball bearing 608. As such, the threaded fastener 604 may alter the amount magnetic attraction the magnet 606 exudes on the ball bearing 608 within the recessed portion of the internal tube 610.

FIG. 6 also illustrates spacers 614(1) and 614(2) which may be used to hold the internal tube 610 against the internal wall of the outer shaft 612 containing the housing 602. Spacers 614(1) and 614(2) may comprise steel and may be welded to a position of the internal tube 610 and/or outer shaft 612. In some embodiments, spacer 614(1) may be position at the end of the internal tube 610 to reinforce the end of the internal tube 610. In some instance, spacer 614(1) may protect the end of the internal tube 610 from potential deformity which may result from repeated contact with the ball bearing 608 as it returns to the recessed portion of the internal tube 610 after a proper swing of the apparatus 600. While FIG. 6 shows two spacers, in other embodiments, any number of spacers greater than one may be used. In other embodiments, the apparatus 600 may be made without spacers while a fastener such as fastener 516 described above with regard to FIG. 5 may be used to secure the internal tube 610.

FIG. 6 also illustrates a shield 616 which may be clamped and/or welded onto the outer shaft 612 to substantially cover a portion of the threaded fastener 604 protruding outward from the apparatus 600. In some instance, shield 616 may protect the threaded fastener 604 from inadvertent contact or adjustment.

Figure 7:
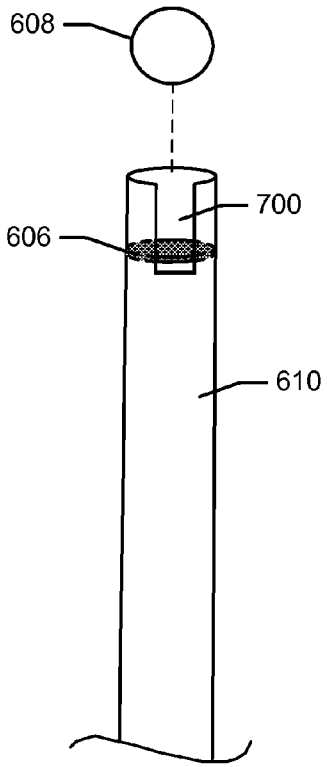
FIG. 7 illustrates a perspective view of the example internal tube as described with reference the apparatus shown in FIG. 6.

FIG. 7 illustrates a perspective view of the example internal tube 610 described in FIG. 6. As described above, the internal tube 610 may include a slot 700 on an end of the internal tube 610 to hold magnet 606 and ball bearing 608. In some embodiments, the slot 700 may extend past a recessed location of magnet 606 in the internal tube 610. For instance, the slot 700 may have a length down the internal tube 610 of greater than 1 inch. However, in other embodiments, the slot 700 may extend to the recessed location of the magnet 606.

While FIG. 7 illustrates a single slot 700 on the internal tube 610, it is understood that more than one slot may be present on the internal tube. For instance, a second slot may be location at a location directly across from slot 700 on the end of the internal tube 610. In this instance as described below with reference to FIG. 11, a tab or magnet platform may be used to hold the magnet 606 relative to the internal tube 610. However, in other embodiments as described below with reference to FIG. 9, a plurality of magnet holders may be incorporated with an inner wall of the internal tube 610 to allow the magnet to securely rest on each magnet holder.

Figure 8:
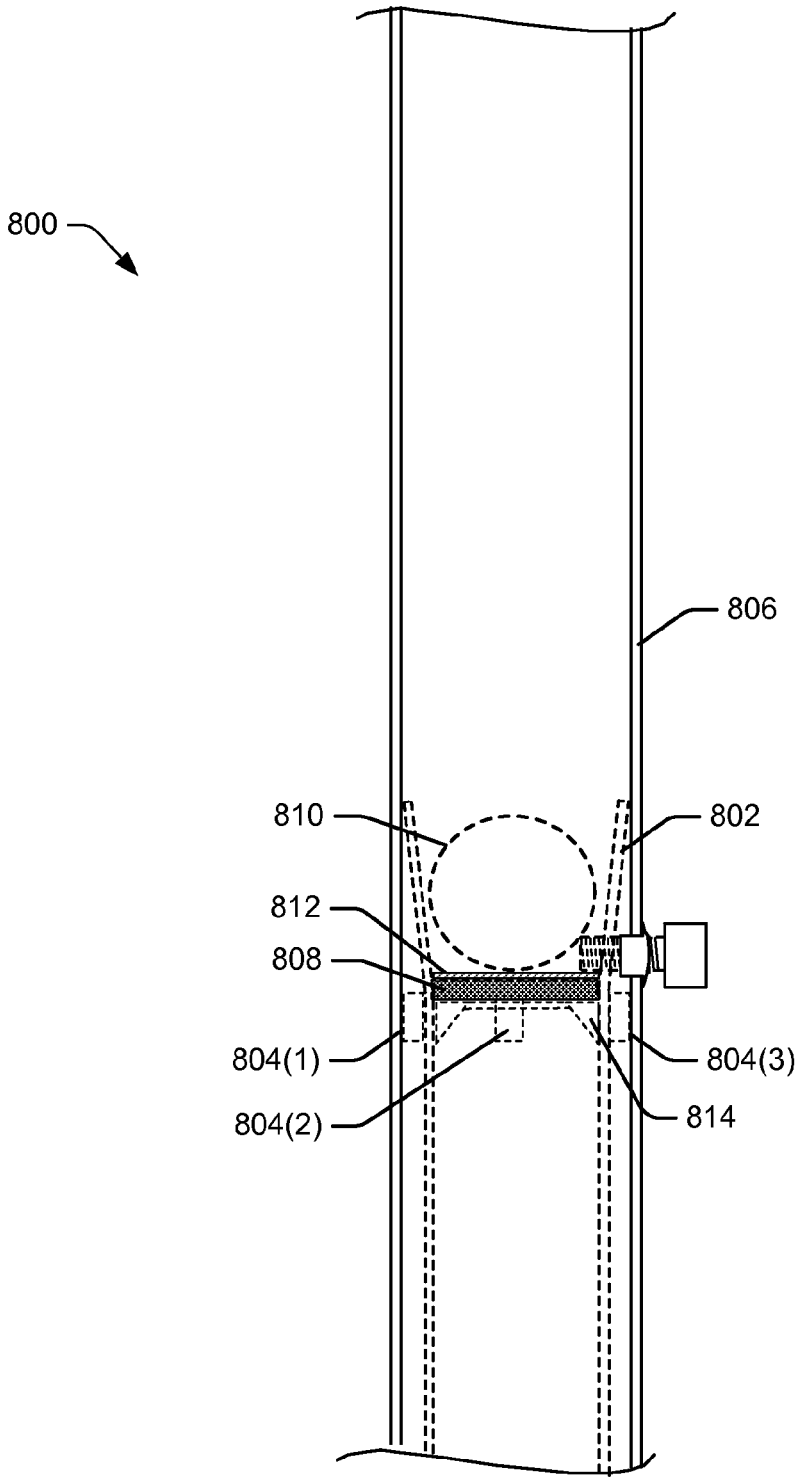
FIG. 8 illustrates a cross-sectional view of an example section of an apparatus showing an internal tube with a fluted or angled end.

FIG. 8 illustrates a cross-sectional view of an example section of apparatus 800 showing an internal tube 802 with a fluted or angled end. In some embodiments, the internal tube 802 may include spacers 804(1)-(3) (and at least one other spacer opposite 804(2)) to position the internal tube substantially in the center of the diameter of the outer shaft 806. In other embodiments, the spacer may be configured as a single spacer which may be placed around the circumference of the outside of the internal tube 802. The fluted internal tube 802 and spacers 804 may be composed of materials similar to any internal tubes described above.

In this embodiment, the end of the internal tube 802 extending upward from the recessed position of the magnet 808 may be fluted such that the edge of the internal tube may substantially touch the inner surface of the outer shaft 806. In some instance, this may allow ball bearing 810 to more easily return to the recessed portion of the internal tube 802 and magnet 808.

FIG. 8 also illustrates a protective disc 812 placed on a top surface of magnet 808 to protect the magnet 808 as the ball bearing 810 returns to the recessed portion of the internal tube 802. In some embodiments, the protective disc 812 may be attached (e.g., with glue or adhesives) to magnet 808. In some embodiments, the protective disc 812 may be a solid flat metallic disc, a solid plastic disc, or a combination thereof. The protective disc 812 may be configured so it does not substantially interfere with the magnetic attraction of the ball bearing 810 with the magnet 808.

As shown in FIG. 8, a magnet platform 816 may be located on an internal portion of the internal tube 802 to secure the magnet 808. In some instance, the magnet platform 816 may be welded to the internal portion of the internal tube 802. However, as described with reference to FIGS. 11, 12A, and 12B, other embodiment for securing a magnet to an apparatus are envisioned.

Figure 9:
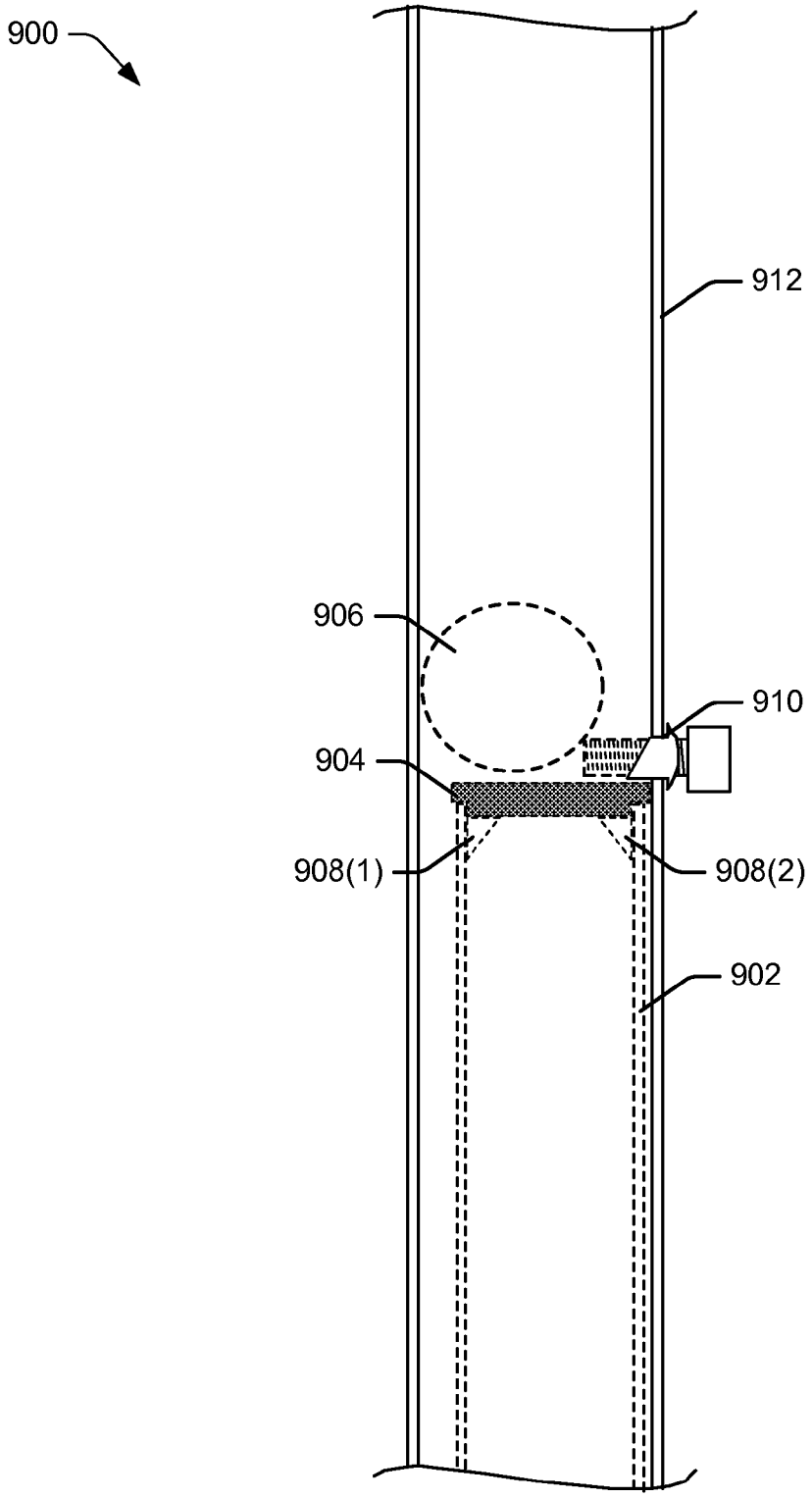
FIG. 9 illustrates a cross-sectional view of an example section of an apparatus showing another embodiment of an internal tube having a magnet attached to an end of the internal tube.

FIG. 9. illustrates a cross-sectional view of an example section of apparatus 900 showing another embodiment of an internal tube 902 having a magnet 904 attached to an end of the internal tube 902. Internal tube 902 may have any configuration as described in the embodiments above. In some embodiments, magnet 904 may have a diameter greater than the outer diameter of the internal tube 902. In other embodiments, magnet 904 may have a diameter substantially the same as the outer diameter of the internal tube 902. For instance, magnet 904 may have a ¾ inch diameter while the outside diameter of the internal tube may also be ¾ inch.

As shown in FIG. 9, magnet 904 may be a two-tier type magnet. In this case, the second or smaller tier may be configured to fix inside the inside diameter of the internal tube 902. In other embodiments, more than one magnet may be used. In some embodiments, the magnet(s) 904 may have rubber coating as described above to protect the magnet from damage which may occur due to contact with ball bearing 906. In some embodiments, the magnet(s) 904 may attached to the end of the internal tube 902 with epoxy, glue, or other adhesive.

As shown in FIG. 9, the internal tube 902 may include magnet holders 908(1) and 908(2) (and at least one other holder not shown) to support the magnet 904 at the end of the internal tube 902. Magnet holder 908(1) and 908(2) (and any others) may be welded to an internal wall of the internal tube 902. In some embodiments, each magnet holder may provide more surface area to attach the magnet 904 to the internal tube 902.

FIG. 9 also shows housing unit 910 of the adjustment mechanism having a tapered body. In some instances, the tapered body of the housing unit 910 may allow the ball bearing 906 to seat or attach to magnet 904. Housing unit 910, like any other housing units described herein, may be welded to an outer shaft 912 of apparatus 900.

Figure 10:
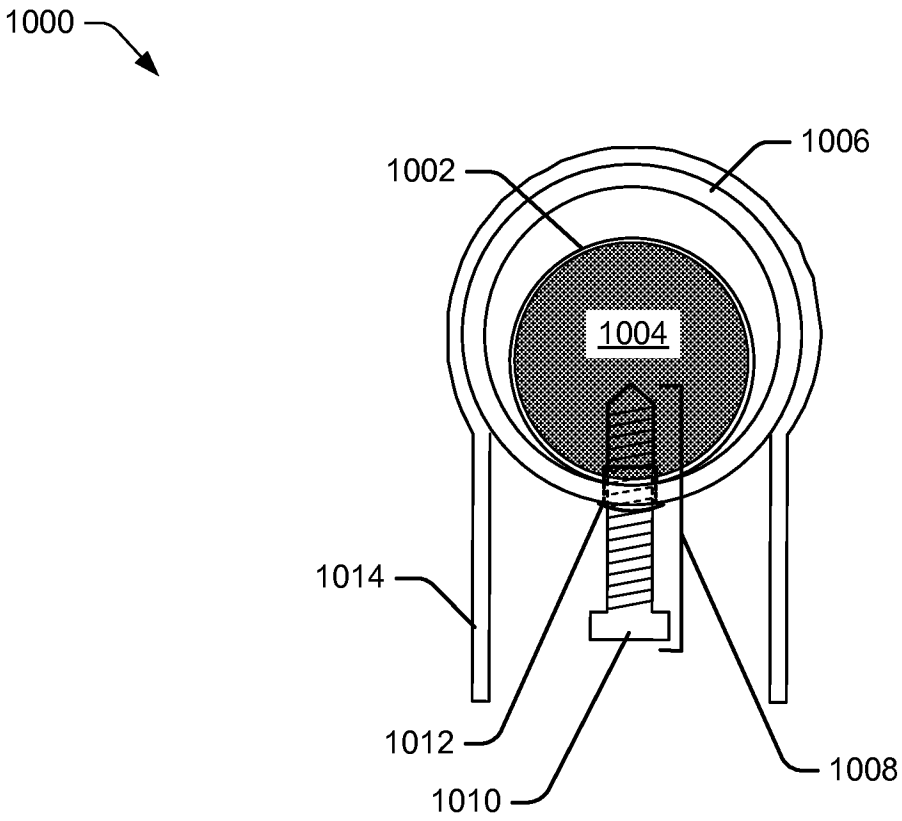
FIG. 10 illustrates a top view of an example apparatus having the example embodiments as shown in FIGS. 6 and/or 9.

FIG. 10 illustrates a top view of an example apparatus 1000 having the example embodiments as shown in FIGS. 6 and/or 9. As shown in FIG. 10, an internal tube 1002 having a magnet 1004 either on the end or recessed within the end may be attached to an outer shaft 1006 by a fastener (omitted for clarity). As described above in FIG. 3, the fastener may be located an end of the outer shaft 1006 below a position where a user may grip apparatus 1000. FIG. 10 shows the internal tube 1002 may be attached to outer shaft 1006 on an inner wall also containing an adjustment mechanism 1008.

Adjustment mechanism 1008 may comprise a threaded fastener 1010 and housing 1012 positioned on the outer shaft 1006 at a position directly above the end of the internal tube 1002 and magnet 1004. Threaded fastener 1010 may have a pointed end as shown in FIG. 10. However, in other embodiments, threaded fastener may have a flat end protruding into the outer shaft 1006. In some embodiments, a head of the threaded fastener 1010 outside the outer shaft 1006 may have a socket head (e.g., hex, Philips, slot, etc) to allow the user to turn the threaded fastener 1010. Additionally and alternatively, the head of the threaded fastener 1010 outside the outer shaft 1006 may have ridged or knurled sides to allow a user to turn the threaded fastener 1010 without the need for an additional tool (e.g. screw driver, Allen wrench, etc.). Housing 1012 may be configured as described above to allow a user to turn the threaded fastener 1010 to increase or decrease an amount of the threaded fastener within the outer shaft 1006.

FIG. 10 also shows a protective shield 1014 protruding away from the outer shaft 1006 to protect the threaded fastener 1010 of the adjustment mechanism 1008. In some embodiments, the protective shield 1014 may be a contiguous piece of metal welded or otherwise attached (e.g., screwed, glued, etc) to the outer shaft 1006. Protective shield 104 may have two wings that extend away from the outer shaft 1006 at a position substantially corresponding to the position of the adjustment mechanism 1008. The wings of the shield 1014 may extend at a length greater than a length of extension of the threaded fastener yet with a length allowing a user to manipulate the threaded fastener 1010.

Figure 11A:
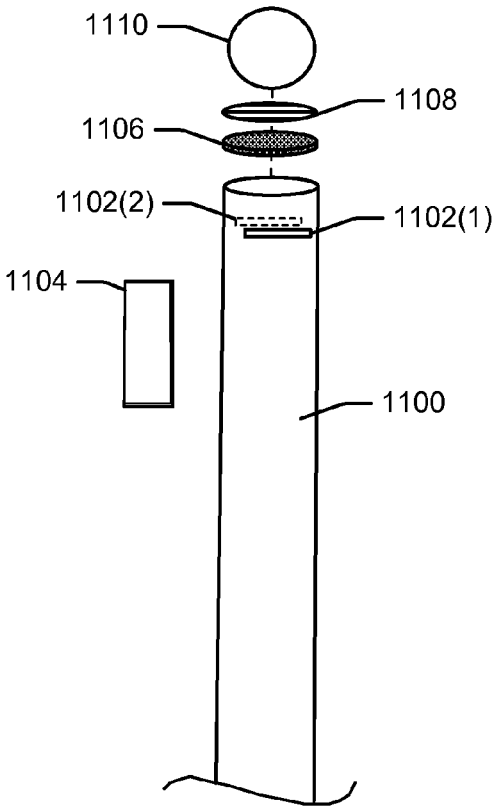
FIGS. 11A and 11B illustrate perspective views of an example embodiment of an internal tube having a recessed magnet platform.
Figure 11B:
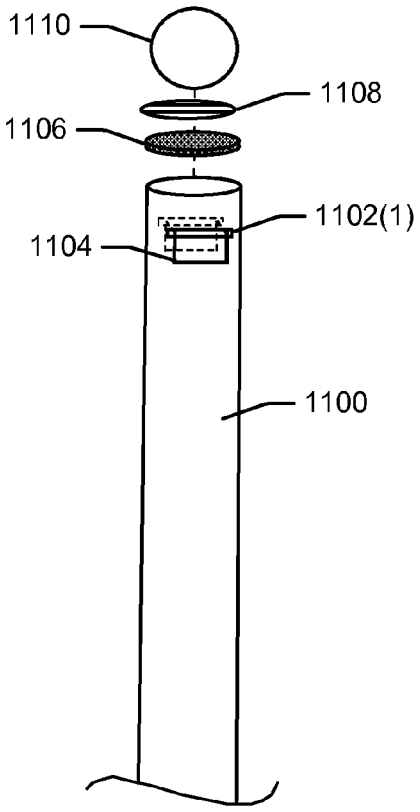

FIGS. 11A and 11B illustrate prospective views of an example embodiment of an internal tube 1100. In some embodiments, the internal tube 1100 may include slots 1102(1) and 1102(2) on internal tube 1100. In some embodiments, the slots 1102(1) and 1102(2) may be positioned opposite each other on the internal tube 1100. In some instances, each slot may be positioned less than ½ inch from the end of the internal tube 1100. In other embodiments, slots 1102(1) and 1102(2) may be positioned greater than ½ inch from the end of the internal tube 1100. In some embodiments, each slot 1102(1) and 1102(2) may be configured to receive a magnet platform 1104 which may be placed through each slot as the magnet platform 1104 protrudes though the inner portion of the internal tube 1100 as shown in FIG. 11B. In some instance, a portion of the magnet platform 1104 remaining on an outer portion of the internal tube 1100 may be folded down substantially flush with the internal tube 1100 such that the magnet platform 1104 is held in place relative to the internal tube 1100.

In some embodiments, the magnet platform 1104 configured to hold a magnet (such as any described above) in a recessed position within the internal tube 1100. A protective disc 1108 (such as any described above) may be placed over the magnet 1106 to prevent direct contact with a ball bearing (such as any described above) 1108 which is magnetically attached to that magnet 1106 within internal tube 1100.

Figure 12:
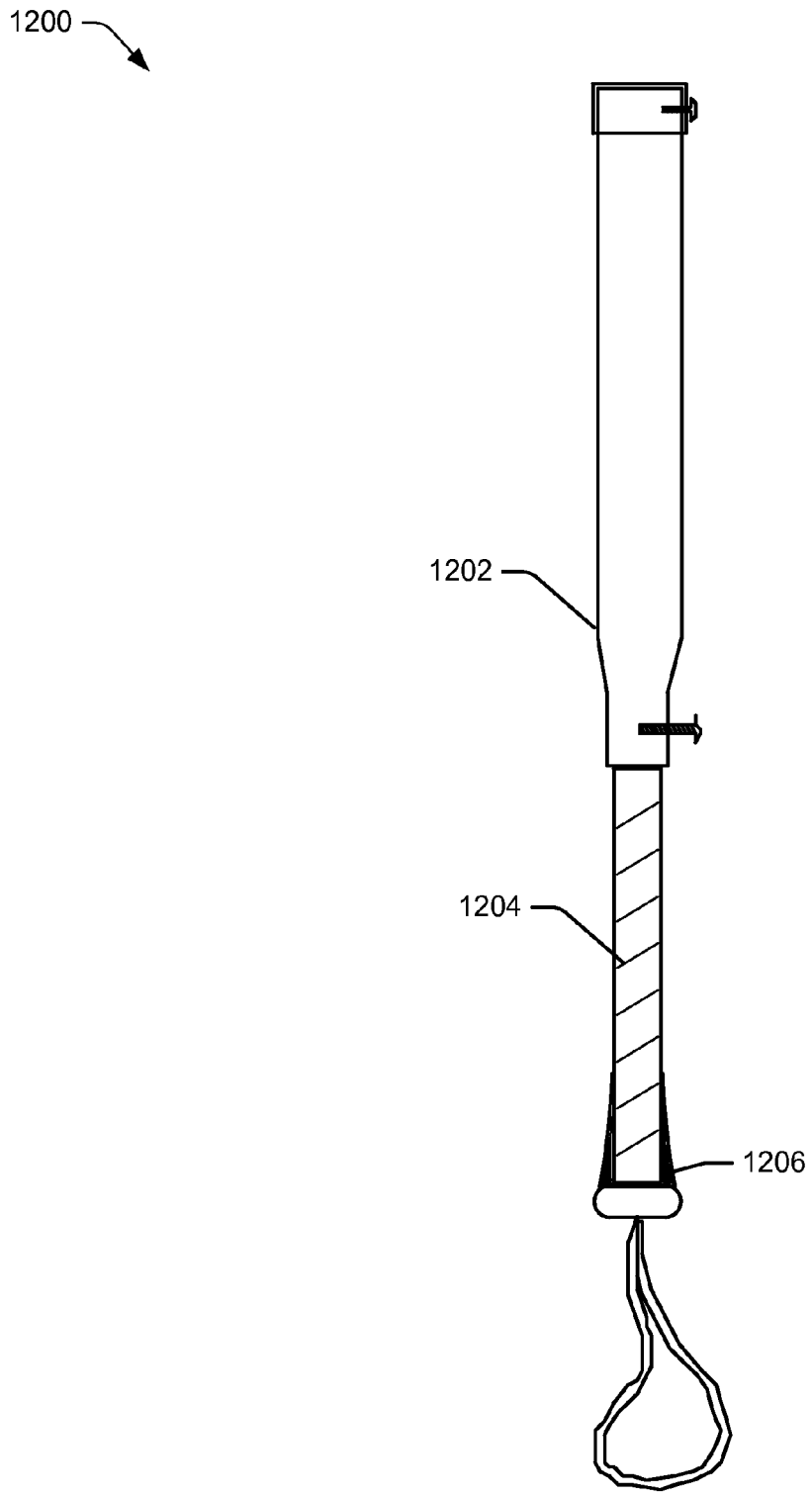
FIG. 12 illustrates an alternative embodiment of apparatus for providing feedback of a proper swing technique having a tapered barrel and/or tapered grip.

FIG. 12 illustrates another example embodiment of an apparatus 1200 for providing feedback of a proper swing technique with a tapered outer shaft 1202. The internal components (e.g., stopper tube, magnet, internal tube, etc.) of apparatus 1200 may be any combination of the component described above. FIG. 12 also illustrates additional features of the grip portion of the outer shaft. For instance, FIG. 12 shows a grip 1204 on the outer shaft. The grip 1204 may be tape, leather or synthetic wrap (e.g., cushioned wrap and/or tacky wrap) wrapped and/or adhered to the outer shaft. Finally, FIG. 12 shows a tapered grip portion 1206. In some embodiments, apparatus 1200 may be manufactured with various tapered grip 1206 amounts. For instance, baseball bats general include a greater taper than softball bats.

It should be noted that any features of a specific embodiment described in this application may be combined or substituted, where possible, with any other feature(s) of another embodiment to construct an apparatus for training a proper swing technique.

Example Process

Figure 13:
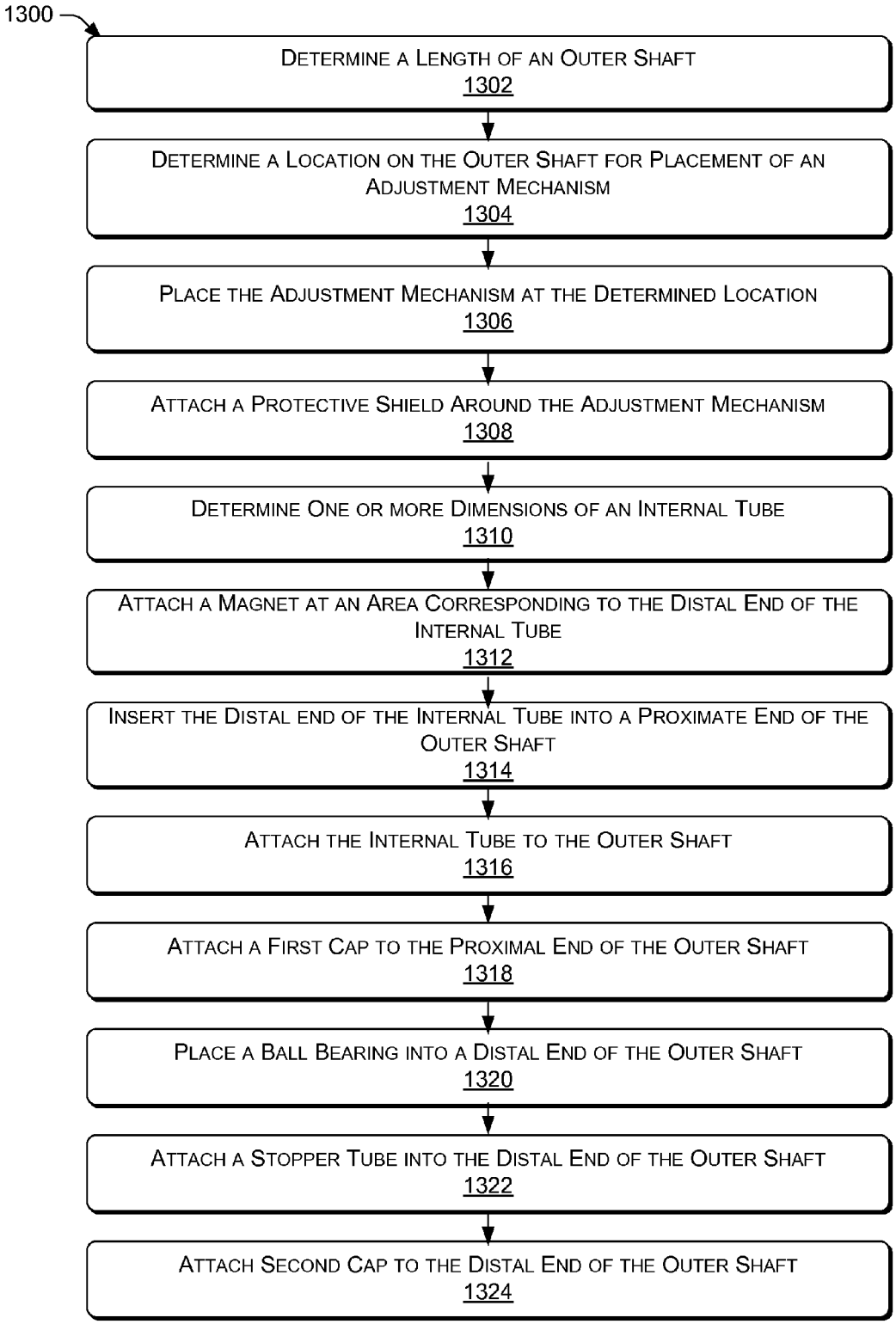
FIG. 13 illustrates a flow graph showing an example process of making an apparatus for providing feedback of a proper swing technique.

FIG. 13 illustrates an example process 1300 for assembling an example apparatus as described above. The process 1300 is illustrated as a logical flow graph. The order in which the operations or steps are described is not intended to be construed as a limitation, and any number of the described operations can be combined in any order and/or in parallel to implement the process 1300.

At 1302, a length of an outer shaft of the apparatus may be determined. For instance, a length such as 24 inches may be determined for the outer shaft which may be cut from a 1 inch diameter hollow steel tube. At operation, 1304, a location on the outer shaft may be determined for placement of an adjustment mechanism. For instance, a location about 8 inches from a proximal end of the outer shaft may be determined as the location on outer shaft. With reference to FIG. 3, the location may correspond to the location of the adjustment mechanism 308 which separates the grip portion 304 from the barrel portion 306 of the outer shaft 302.

At operation 1306, the adjustment mechanism may be placed at the determined location on the outer shaft. For instance, a hole may be drilled in the outer shaft for placement of a housing unit which may be welded to the outer shaft. The housing unit may secure the threaded fastener which protruded into and out of the inner portion of the outer shaft to form the adjustment mechanism.

At operation, 1308, a protective shield may be attached around the outer shaft at the location of the adjustment mechanism. With reference to FIG. 10, the protective shield 1014 may be a winged clip welded and/or screwed in place to protect the threaded fastener of the adjustment mechanism.

Dimensions of an internal tube may be determined at operation 1310. For instance, the internal tube may have a diameter less than the outer shaft and be cut to about 8 inches. As described above with reference to FIG. 7, the internal tube may be configured with a slot to allow the adjustment mechanism to interact with a distal end of the internal tube. At operation 1312, a magnet may be attached at an area corresponding to the distal end of the internal tube. Again wither reference to FIG. 7, the magnet may be placed or secured to a recessed portion of the internal tube. In some embodiments, the magnet may be coated with rubber/plastic and/or be have a protective disc.

At operation 1314, the distal end of the internal tube may be placed into the inner portion of the outer shaft at a proximate end. As shown with reference to FIG. 6, the internal tube with attached magnet may be placed in the outer shaft such that the adjustment mechanism is directly abutted with the magnet. At operation 1316, the internal tube may be attached to an inner portion of the outer shaft. With reference FIG. 5, a fastener such as fastener 516 may attach the internal tube to the outer shaft.

At operation 1318, a first cap may be attached to the proximal end of the outer shaft. In some embodiments as shown in FIG. 5, the fastener 516 may also attach the first cap to the outer shaft.

At operation 1320, a ball bearing having ferromagnetic qualities may be placed into the outer shaft at an end distal to the internal tube. In some embodiments, the ball bearing may then interact with the magnet on the internal tube and the adjustment mechanism on the outer shaft. At operation 1322, a stopper tube may be attached to the distal end of the outer shaft. With reference to FIG. 5, the stopper tube may include an energy absorbing cylinder and fastener within a housing.

At operation 1324, a second cap may be attached to the distal end of the outer shaft. For instance, with reference to FIG. 5, a fastener 512 may be used to secure both the stopper tube and the second relative to the distal end of the outer shaft.

CONCLUSION

Although the disclosure describes embodiments having specific structural features and/or methodological acts, it is to be understood that the claims are not necessarily limited to the specific features or acts described. Rather, the specific features and acts are merely illustrative some embodiments that fall within the scope of the claims of the disclosure.

What is claimed is:

1. An apparatus for providing feedback of a swing technique, the apparatus comprising:

an outer shaft having a ball bearing located within;

a first tube disposed within the outer shaft and including a portion that is configured to receive the ball bearing;

a magnet disposed in the portion of the first tube;

a second tube disposed with the outer shaft at an end opposite the first tube, the second tube configured to stop the ball bearing as the ball bearing travels through the outer shaft and to provide at least one of haptic or auditory feedback; and an adjustment mechanism disposed on the outer shaft, the adjustment mechanism comprises a housing unit attached to the outer shaft and a fastener configured to protrude though the housing unit into an inner portion of the outer shaft at a location where the magnet and the ball bearing interface, and wherein an amount of the fastener protruding into the inner portion alters a magnetic connection of the magnet and the ball bearing.

2. The apparatus as recited in claim 1, wherein the outer shaft is about 24 inches in length and is about 1 inch in diameter.

3. The apparatus as recited in claim 1, wherein the first tube is about 8 inches in length and is about ⅝ inch in diameter.

4. The apparatus as recited in claim 1, wherein the magnet has a diameter substantially the same as the diameter of the first tube; and wherein the magnet is recessed within the portion of the first tube.

5. The apparatus as recited in claim 1, wherein the second tube comprises:

an energy absorbing cylinder with a metallic fastener facing the first tube; and a housing to encase the energy absorbing cylinder.

6. A method of assembling an apparatus comprising:

placing an adjustment mechanism at a location on a side of an outer shaft, the adjustment mechanism configured to protrude into an inner portion of the outer shaft, wherein an amount of the adjustment mechanism protruding into the inner portion of the outer shaft alters a magnetic connection between a magnet and a ball bearing;

attaching the magnet proximate to an end to an internal tube;

inserting the end of the internal tube into the inner portion of the outer shaft such that the magnet interfaces with a portion of the adjustment mechanism;

placing the ball bearing into an end of the outer shaft distal from the internal tube; and attaching a stopper tube to the end of the outer shaft distal from the internal tube.

7. The method as recited in claim 6, further comprising:

attaching, with a first fastener, the internal tube to the inner portion of the outer shaft;

attaching a protective shield at a location of the adjustment mechanism on the outer shaft;

attaching, with the first fastener, a first cap to an end of the outer shaft proximate to the internal tube; and attaching, with a second fastener, a second cap to the end of the outer shaft distal from the internal tube, wherein the second fastener is further configured to attach the stopper tube to the end of the outer shaft distal from the internal tube.

8. The method as recited in claim 6, wherein the location on the outer shaft for placement of the adjustment comprises a location about 8 inches from an end of the outer shaft proximate to the internal tube.

9. The method as recited in claim 6, wherein attaching the magnet proximate to the end of the internal tube comprises attaching the magnet to a recessed portion within the end of the internal tube.

10. A device comprising:

a shaft configured to hold a tube in an inner portion at an end of the shaft, the tube having a magnet positioned distal to the end;

a disc to cover the magnet, the disc configured to absorb energy from a ball bearing as the ball bearing contacts the magnet; and an adjustment mechanism disposed on the shaft and configured to adjust a magnetic connection of the ball bearing to the magnet when the ball bearing is positioned within a predetermined distance to the magnet.

11. The device as recited in claim 10, wherein the adjustment mechanism comprises a housing and a fastener protruding into the inner portion of the shaft to adjust an amount of the ball bearing that attaches to the magnet.

12. The device as recited in claim 11, wherein the fastener is configured to be manipulated to increase or decrease an amount of the fastener protruding within the inner portion of the shaft.

13. The device as recited in claim 10, where the magnet is positioned at a recessed location in the tube and the tube includes a slot to enable the adjustment mechanism to interface with the magnet.

14. The device as recited in claim 10, wherein the shaft comprises hollow steel tubing with diameter of 1 inch, the tube comprises hollow steel tubing with a diameter of ⅝ inch and the magnet comprises a neodymium magnet with at least a thickness of 1/32 inch and a diameter of ½ inch.

15. The device as recited in claim 10, wherein the magnet is coated in plastic, rubber, silicone, or another elastic polymer.

16. The device as recited in claim 10, further comprising:

a stopper tube attached the shaft at an end opposite the tube, the stopper tube configured to stop the ball bearing as the ball bearing travels through the shaft and to provide at least one of haptic or auditory feedback, the stopper tube comprising:

an energy absorbing cylinder with a metallic fastener facing the tube; and a housing to encase the energy absorbing cylinder.

17. The device as recited in claim 10, wherein the adjustment mechanism, ball bearing, and the magnet are configured to interface on the inner portion of the shaft at about 8 inches from the end of the shaft.

18. The device as recited in claim 10, wherein the magnet is configured to: attract the ball bearing based on a setting of the adjustment mechanism, and release the ball bearing when the device is swung in a predetermined manner.

19. The device as recited in claim 10, wherein the adjustment mechanism is disposed on the shaft at a location proximate to a grip portion of the device.

* * * * *